US007044026B2

(12) United States Patent
Holland et al.

(10) Patent No.: US 7,044,026 B2
(45) Date of Patent: May 16, 2006

(54) INK CONTAINER OPENER

(75) Inventors: Carl William Holland, Webster, NY (US); Donald E. Snyder, Jr., Spencerport, NY (US); Michael J. VanDerMeid, Livonia, NY (US)

(73) Assignee: Nu-kote International, Inc., Franklin, TN (US)

( * ) Notice: Subject to any disclaimer, the term of this patent is extended or adjusted under 35 U.S.C. 154(b) by 61 days.

(21) Appl. No.: 10/770,996

(22) Filed: Feb. 3, 2004

(65) Prior Publication Data

US 2005/0166711 A1 Aug. 4, 2005

(51) Int. Cl.
*B67B 7/00* (2006.01)

(52) U.S. Cl. ..... 81/3.25; 81/3.07; 81/3.31

(58) Field of Classification Search ..... 81/63, 81/63.1, 63.2, 61, 62, 3.25, 3.07, 3.31, 3.36, 81/3.4; D8/33

See application file for complete search history.

(56) References Cited

U.S. PATENT DOCUMENTS

| | | | | | |
|---|---|---|---|---|---|
| 2,005,410 | A * | 6/1935 | Balz | 81/3.25 |
| 3,583,263 | A * | 6/1971 | Herigstad | 81/3.25 |
| 4,463,631 | A * | 8/1984 | Barnes et al. | 81/3.09 |
| 4,911,038 | A * | 3/1990 | Ferrin | 81/3.09 |
| 4,981,228 | A * | 1/1991 | Kahn | 215/226 |
| 6,098,497 | A * | 8/2000 | Larose | 81/3.4 |

* cited by examiner

*Primary Examiner*—Lee D. Wilson
*Assistant Examiner*—Alvin J. Grant
(74) *Attorney, Agent, or Firm*—Fay, Sharpe, Fagan, Minnich & McKee, LLP

(57) ABSTRACT

An ink container opener has first and second portions approximately perpendicular to each other to form an L-shaped opener. The first portion has an opening having a plurality of ridges extending along opposite sides of the opening. An ink container is received within the opening and force is applied to the ink container to remove a cap from a body of the ink container.

18 Claims, 3 Drawing Sheets

INK CONTAINER OPENER

The invention relates to an ink container opener. More particularly, it relates to an ink container opener for removing a cap from a body of an ink container, used in ink jet printing.

BACKGROUND OF THE INVENTION

An ink container typically includes a container body and a container cap. The cap is usually ultrasonically welded, glued or heat staked to the body after the container has been filled with ink during initial manufacturing. Once the ink has been depleted from the container, the container can be reused by refilling it with ink. Refilling ink cartridges with ink is a two step process. First, some means must be provided to break open and remove the cap from the cartridge. Then, the reservoir must be refilled. To assist in refilling the ink container, the user usually either removes the cap or drills holes into the cap to provide access into the interior of the container so that ink can be added. At times the ink container cap may be fabricated of a rigid plastic material that is difficult to penetrate using a hand-held drill bit which is typically supplied with ink refill kits. Thus, drilling holes into the cap can be difficult for the user, especially for a color ink container where three holes are required.

Accordingly, there is a need for a means for easily removing the cap from an ink supply container to enable the addition of more ink, thereby extending the useful life of the container. Thus, there is a need for an ink container opener that allows the consumer or user to remove the container cap without drilling holes into the cap.

One drawback of prior ink cartridge openers is the lack of a firm grip for the cartridge during a somewhat delicate procedure of separating ink top and bottom portions of the cartridge. Furthermore, another drawback of some of the openers is they require two or more pieces. While these multi-piece openers have been effective apparatus for opening cartridges, there is a need for an improved one-piece ink cartridge opener having enhanced gripping and stability features.

SUMMARY OF THE INVENTION

The present invention is directed to an ink cartridge opener which removes a cap from the ink supply cartridge to enable the addition of more ink, thereby extending the useful life of the cartridge. The present invention includes a container opener which enables the consumer to remove the container cap using a single piece L-shaped opener. A first or holder member holds the cap of the container and a second member or base member provides support to the container and cap when force is applied to the container body. The user pushes down and exerts force onto an end of the container body with the palm of his or her hand. This downward force then enables the cap to be disconnected or separated from the body. The opener enables a consumer to remove the cartridge cap using an L-shaped ink container opener design which securely holds the cap of the cartridge while the consumer pushes down on the cartridge body with the palm of his or her hand.

More particularly, an ink container opener has first and second portions approximately perpendicular to each other to form an L-shaped configuration. The first portion has an opening with a plurality of ridges extending along opposite sides of the opening. The opening is substantially rectangular in shape. The ridges are substantially rectangular in shape and are equally spaced apart from one another. A plurality of reinforcement members are interconnected between the first and second portions. The reinforcement members are equally spaced apart and are parallel to each other. The reinforcement members can be of a unitary construction with the first and second portions.

The first portion and the second portion are formed of a unitary construction.

One aspect of the present invention is that the user's weight can be used in addition to hand and arm muscles to apply force to the opener to break open an ink cartridge.

Another aspect of the invention is that the opener can rest on the top of a work surface to absorb the applied force, thereby enabling operation with one hand.

Another aspect of the invention is that a consumer can apply force to the opener on the floor by the ball of a foot.

Another aspect of the invention is that the opener provides a mechanical advantage of approximately eight to one (8:1).

Another aspect of the invention is an opening with serrated edges to provide a more secure grip on the cap.

Yet another aspect of the invention is a one-piece compact configuration which is space efficient and requires a small increase in container volume for a ink container kit.

Still other aspects and advantages of the invention will become apparent to those skilled in the art upon a reading and understanding the following detailed description.

BRIEF DESCRIPTION OF THE DRAWINGS

The invention may take form in certain components and structures, several preferred embodiments of which will be illustrated in the accompanying drawings wherein.

DETAILED DESCRIPTION OF THE PREFERRED EMBODIMENTS

Figure 1:
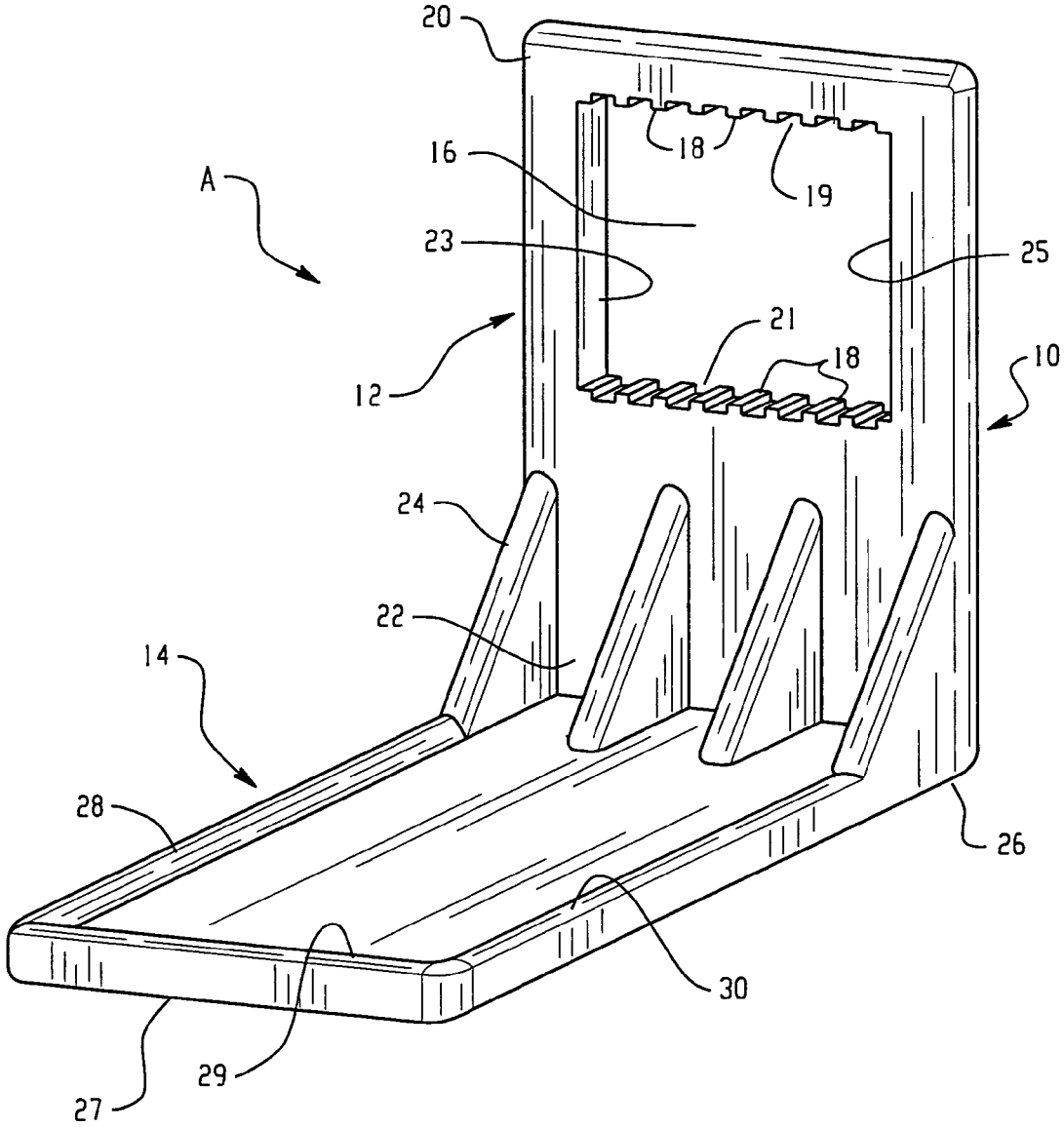
FIG. 1 is a perspective view of a one-piece ink container opener in accordance with a preferred embodiment of the present invention.
Figure 2C:
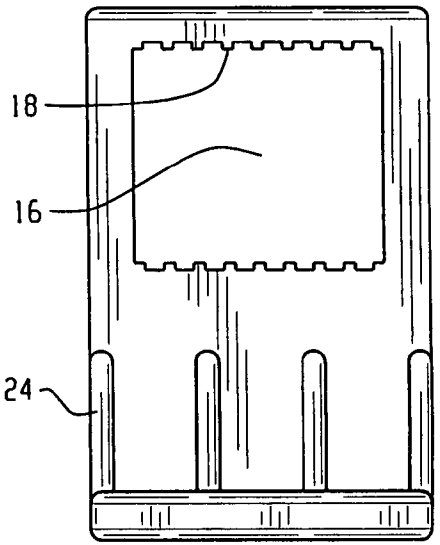
FIG. 2C is a left-side elevational view of the ink container opener of FIG. 1.
Figure 2A:
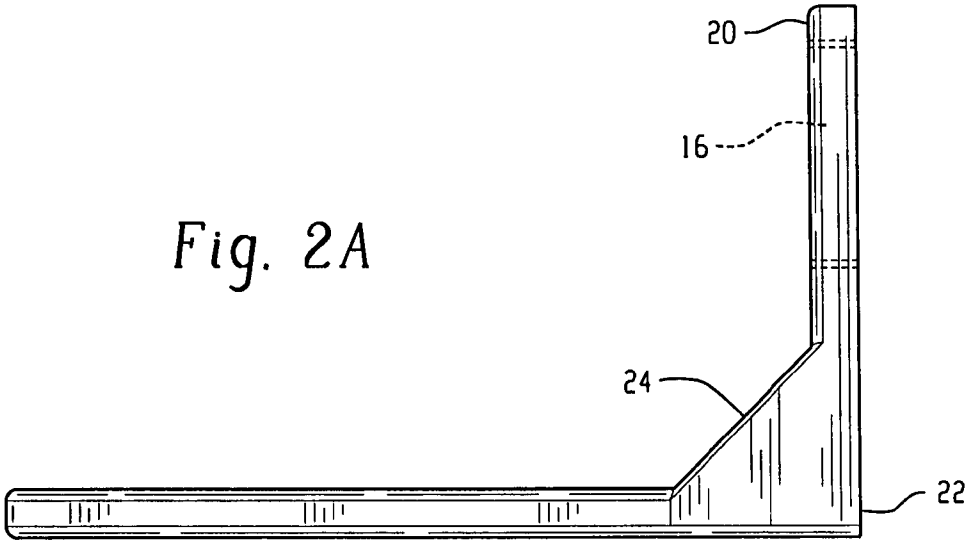
FIG. 2A is a side elevational view of the ink container opener of FIG. 1.
Figure 2B:
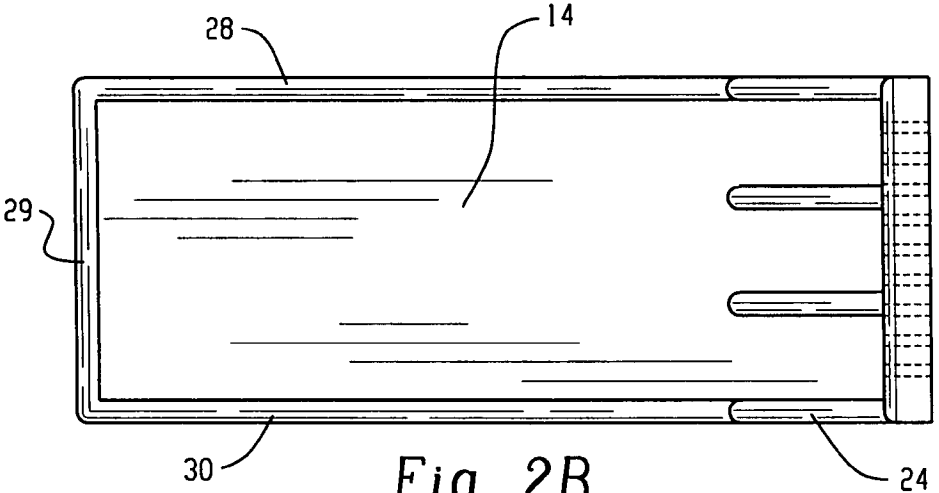
FIG. 2B is a top plan view of the ink container opener of FIG. 1.

Referring now to the drawings, wherein the showings are for purposes of illustrating the preferred embodiments of this invention only and not for purposes of limiting same, FIGS. 1 and 2A–2C show an ink container opener A having a body 10 with a first member or arm 12 and a second member or arm 14 substantially perpendicular to each other. Each of the arms is substantially rectangular in shape and has flat surfaces. Arm 14 is shown to be longer along a longitudinal axis than arm 12. First arm or holder member 12 has an opening 16 adapted to receive a first portion or a cap of an associated ink container B (see FIG. 3). Opening 16 is shown to be rectangular in configuration; however, other shapes are also contemplated by the invention. A plurality of ridges 18 extend along edges 19, 21 of opening 16. As seen in FIGS. 1 and 2C, the ridges are parallel to each other and are equally spaced apart. The ridges are also shown to be on edges which are opposite one another in the opening. However, ridges could also be provided on the opposing edges 23, 25. The ridges are shown to be shaped as rectangular bars; however, the ridges could be formed with sharp or serrated edges to provide a grip for engaging the outer surface of an ink cartridge cap member 40 (see FIG. 3).

The holder portion 12 and the second arm or base portion 14 are formed of a unitary construction from metal, or another suitable material, and are oriented approximately perpendicular to each other to form an L-shaped configuration. Reinforcement members 24 can be provided and interposed between the two members to provide additional strength and rigidity to the opener. As shown in the figures, reinforcement members 24 are generally triangular in shape and are parallel to and approximately equally spaced apart from each other. The reinforcement members can be of a unitary construction with the base and holder members; however, they can also be welded to or secured to the two members by other suitable means. Holder member 12 has a first end 20 and a second end 22 where the opening is positioned adjacent to the first end and the reinforcement members are positioned adjacent to the second end. Base member 14 has a first end 26 and a second end 27 where the reinforcement members are positioned adjacent the first end. Raised edges or ridges 28, 29, 30 are positioned around an outer edge of base member 14 to provide additional strength and rigidity to the base member.

Figure 3:
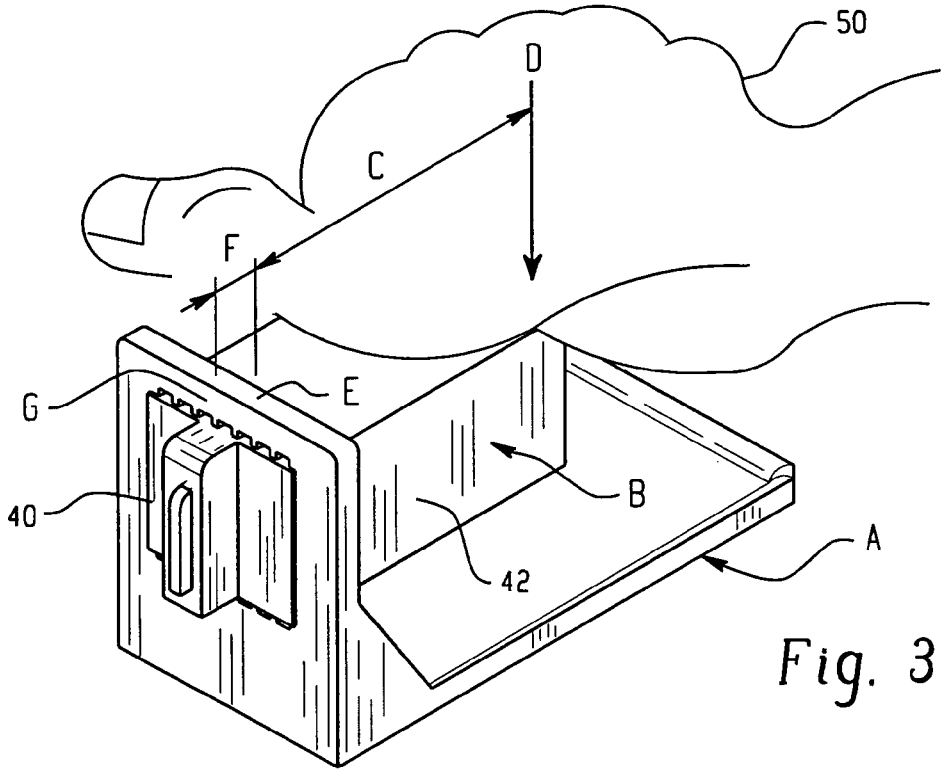
FIG. 3 is a perspective view of a user manually applying force to an ink container mounted in the ink container opener of FIG. 1; and, FIG. 4 is a perspective view of an ink container refill kit with the ink container opener of FIG. 1 mounted therein.

Referring now to FIG. 3, usage of the opener to separate a cap from an ink container will now be described. An ink container is positioned within the ink container opener by inserting cap 40 of the container within opening 16. A lip or ridge on the bottom edge of the container cap abuts the ridges 18 of opening 16. As will be appreciated from FIGS. 1 and 3, the container body is supported in cantilever fashion and a user's hand 50 then applies a downward force to the ink container thereby engaging the cap with the ridges 18 of opening 16 and applying force to the second portion or main body 42 of the container until the cap is disconnected from or separated from the container body. The user's weight can be used in addition to hand and arm muscles. The opener can be placed on a work surface such as a desk or table to absorb the applied force of the user. This would enable a one-handed application of force to the ink container. Alternatively, for a user with weak hands or arms, or when the cap is too secure to achieve separation by hand, the opener can be placed on a floor surface and the ball of the user's foot can apply the force directly to the ink container body. As seen in FIG. 3, the force to disconnect the cap from a container is applied in a downwardly direction by the palm of a user's hand. Alternatively, the force can be applied in a horizontal or other direction based on the orientation of the ink container opener.

The opener provides a mechanical force advantage of approximately eight to one (8:1). That is, referring to FIG. 3, the distance C from the force application point D in a longitudinal direction to the cap or body joint E is approximately eight times greater than the distance F from the cap support point G to the cap body joint E.

Figure 4:
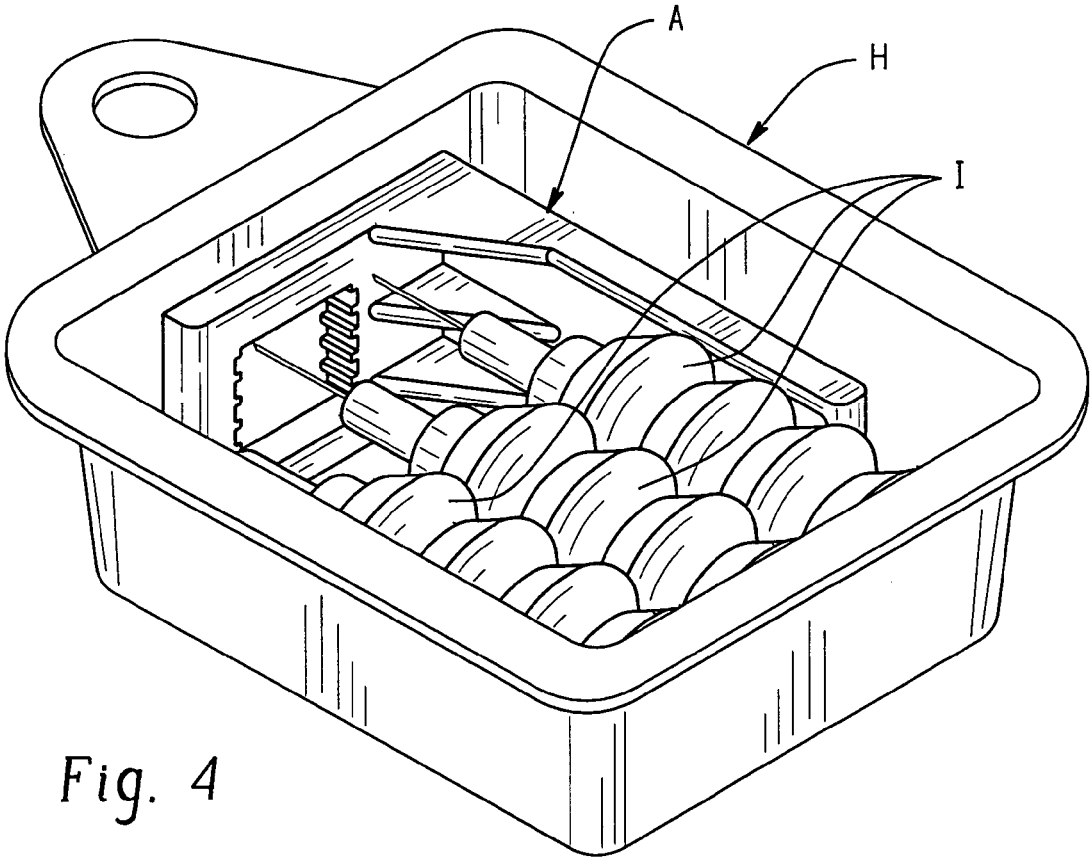

The base member is shown to be longer in a longitudinal direction than the holder member; however, other dimensions for the members can also be used. The opener is formed with a substantial L-shaped configuration. The L-shape of the opener allows for space efficiency within a refill kit container. That is, the opener can be placed into a corner of a refill kit container H as seen in FIG. 4 along with a plurality of ink supply bottles I and requires only a small increase in the refill kit container volume. When the ink container is installed within the opener, a support member surface or base member surface extends along a longitudinal axis of the ink container.

The invention has been described with reference to a preferred embodiment. Obviously, alterations and modifications will occur to others upon a reading and understanding of this specification. The invention is intended to include all such modifications and alterations insofar as they come within the scope of the appended claims or the equivalents thereof.

What we claim is:

1. An ink container opener comprising:

a first portion:

a second portion connected to said first portion, wherein said first and second portions are approximately perpendicular to each other; said first portion comprising an opening, said opening comprising a plurality of ridges extending along opposite sides of said opening, wherein said opening is substantially rectangular in shape; and, a plurality of reinforcement members interconnected between said first and second portions.

2. The ink container opening of claim 1, wherein said ridges are substantially rectangular in shape and are equally spaced apart from one another.

3. The ink container opener of claim 1, wherein said second portion is longer than said first portion along a longitudinal axis of said first and second portions.

4. The ink container opener of claim 1, wherein said first portion and said second portion are formed of a unitary construction.

5. The ink container opener of claim 1, wherein said second portion comprises a first edge, a second edge and a third edge, and at least one edge member extending along one of said edges.

6. The ink container opener of claim 1, wherein said reinforcement members are equally spaced apart and parallel to one another.

7. The ink container opener of claim 6, wherein said reinforcement members are welded to said first portion and said second portion.

8. The ink container opener of claim 7, wherein said reinforcement members are substantially triangular in shape.

9. The ink container opener of claim 8, wherein said reinforcement members are of unitary construction with said first and second portions.

10. The ink container opener of claim 1, wherein said opener is substantially L-shaped.

11. The ink container opener of claim 1, wherein said second portion is longer along a longitudinal axis than said first portion.

12. An ink container opener comprising:

a container holder member adapted to hold a portion of an ink container;

a support member adapted to be placed adjacent a work surface, wherein said holder member comprises a substantially rectangular opening for receiving and holding said portion of said ink container; and said holder member and said support member are formed of a unitary construction and are approximately perpendicular to one another.

13. The ink container opener of claim 12, wherein said opening comprises a plurality of teeth along an inner edge thereof.

14. The ink container opener of claim 12, wherein said ink container opener further comprises a plurality of reinforcement members interconnecting said holder member and said support member.

15. The ink container opener of claim 12, wherein said support member comprises a support surface for supporting said opener when force is applied to said holder member.

16. The ink container opener of claim 15, wherein said support member surface extends along a longitudinal axis of said ink container.

17. The ink container opener of claim 12, wherein said opening of said holder comprises a plurality of ridges formed on internal surfaces thereof.

18. A method of opening an ink container of the type having first and second connected container portions, said method using a one-piece ink container opener having a container first member and a second member, said first member having an opening for receiving a first portion of said ink container, said method comprising:

placing said second member of said one-piece opener on a work surface such that said first member is perpendicular to said work surface;

inserting said first portion of said container within said opening of said first member; and, applying lateral force to the second portion of the container until said container first portion is disconnected from said container second portion.

* * * * *